US005579975A

United States Patent [19]

Moorman

[11] Patent Number: 5,579,975

[45] Date of Patent: Dec. 3, 1996

[54] FASTENER DRIVING TOOL FOR LOCATING A PRE-EXISTING THROUGH HOLE IN A WORKPIECE AND DRIVING A FASTENER THERETHROUGH

[75] Inventor: Charles J. Moorman, Cincinnati, Ohio

[73] Assignee: Senco Products, Inc., Cincinnati, Ohio

[21] Appl. No.: 424,831

[22] Filed: Apr. 19, 1995

[51] Int. Cl.[6] ..... B25C 1/04

[52] U.S. Cl. ..... 227/8; 227/32; 227/119; 227/130; 227/136

[58] Field of Search ..... 227/32, 119, 136, 227/8, 130, 120, 127, 107

[56] References Cited

U.S. PATENT DOCUMENTS

| | | | |
|---|---|---|---|
| 3,891,133 | 6/1975 | Maier et al. | 227/136 |
| 4,485,952 | 12/1984 | Weis | 227/32 |
| 4,856,696 | 8/1989 | Seld | 227/8 |
| 4,928,867 | 5/1990 | Jensen | 227/32 |
| 5,052,607 | 10/1991 | Dutton | 227/119 |
| 5,238,167 | 8/1993 | Howard et al. | 227/32 |
| 5,452,835 | 9/1995 | Shkolnikov | 227/32 |

*Primary Examiner*—Scott A. Smith
*Attorney, Agent, or Firm*—Jerrold J. Litzinger

[57] ABSTRACT

A fastener driving tool capable of locating a preformed hole in a first workpiece, aligning the drive track of the tool with the hole, and thereafter driving a fastener, such as a nail, through the hole and into a second workpiece to attach the first workpiece to the second workpiece. The tool has a magazine comprising an outer portion affixed to the tool and its drive track containing guide body, and an inner portion containing a strip of nails and pivoted at its rearward end to the rearward end of the outer magazine portion. The inner magazine portion is pivotable within the outer magazine portion between a first position wherein the forwardmost nail of the strip extends well beyond the nose of the guide body serving as a probe to locate and enter the workpiece hole, and a second position wherein the forwardmost nail of the strip is still engaged in the workpiece hole and is properly aligned in the drive track to be driven by the tool driver through the first workpiece hole and into the second workpiece. The inner magazine is operatively connected to safety trip which is shiftable between a first, disabling position when the inner magazine portion is in its first position and a second enabling position allowing the tool to be actuated when the inner magazine is in its second position. The inner magazine portion and the safety trip are biased to their first positions.

14 Claims, 6 Drawing Sheets

FASTENER DRIVING TOOL FOR LOCATING A PRE-EXISTING THROUGH HOLE IN A WORKPIECE AND DRIVING A FASTENER THERETHROUGH

TECHNICAL FIELD

The invention relates to a fastener driving tool for locating a pre-existing hole in a first work piece and for driving a fastener through the hole and into a second workpiece, and more particularly to such a tool having a magazine with a fastener carrying portion which is pivotable between a first position wherein the forwardmost fastener can locate and enter the hole and a second position wherein the forwardmost fastener can be driven through the hole and into the second workpiece.

BACKGROUND ART

Prior art workers have devised many types of powered, hand-held, fastener driving tools. The tools can be designed to drive various types of fasteners such as nails, staples, blind rivets, and the like. The fastener driving tools may be driven by compressed air, internal combustion means, or electrical means such as a solenoid, or a flywheel assembly. The present invention is applicable to such fastener driving tools, and is not specifically limited to the types of fasteners being driven or the drive means of the tool. For purposes of an exemplary showing, the invention will be described in terms of its application to a pneumatic fastener driving tool designed to drive nails.

The invention is applicable to any situation wherein a first workpiece is to be attached to a second workpiece, the first workpiece having a pre-existing hole through which the nail is to be driven into the second workpiece, to join the workpieces together. Fastener driving tools in general, and nailers in particular, are fairly large, bulky tools comprising a main body portion, a handle portion, a magazine portion and a guide body. The guide body contains the drive track for the nails, the forwardmost nail in the magazine being driven out of the drive track by a piston powered driver. The lowermost part of the guide body, generally referred to as the tool nose portion, is such that it would be substantially impossible to accurately line up the drive track of the tool with a pre-existing hole in a workpiece having a diameter to just nicely receive the shank of a nail.

One of the most common instances where this problem arises is found in the attachment of metallic brackets to wooden structural frame members to join the structural frame members together in a fixed relationship with respect to each other. The brackets are normally formed of sheet metal or plate. If the drive track of a nailer is not properly aligned with a pre-formed nail hole in the metallic bracket, the bracket will not be properly attached to the wooden workpiece and it could also further result in deformation of the forwardmost nail, which might become jammed in the drive track.

Prior art workers have attempted to solve this problem in a number of ways. U.S. Pat. No. 4,928,867 teaches the use of metallic brackets or connectors which have particular formations formed therein in conjunction with each hole. These may constitute inner and outer raised tings on the metallic connector surrounding a nail hole and forming a groove there between, an arcuate raised ridge, a series of tabs, or the like. The fastener driving tool an alignment foot which coacts with these formations to align the drive track with the nail hole in the connector or bracket.

U.S. Pat. No. 5,193,730 teaches a pneumatic nailer provided with a nail push piston mechanism which separates the forwardmost nail from the strip thereof and extends the forwardmost nail below the nailers' nose portion. A nail holding mechanism firmly engages the body portion of the nail, maintaining the nail in its protruding position so that it can be used to find a hole. Once so positioned, the nail is driven in place, the holding mechanism releasing the nail.

U.S. Pat. No. 5,238,167 teaches a nailer having a probe by which proper alignment of the drive track and a pre-existing hole is achieved. The probe is moved out of the way by the nail during the driving thereof.

The present invention is based upon a different approach. An otherwise standard pneumatic nailer is provided with a modified guide body and a modified magazine. The magazine is made up of an inner magazine portion which carries a strip of nails. The inner magazine portion is surrounded by an outer magazine portion attached to the handle portion of the pneumatic nailer and the guide body. The inner magazine portion is pivoted at its rearward end within the outer magazine portion and is shiftable between a first position wherein the forwardmost nail of a strip is extended beyond the nose sufficiently to enable the forwardmost nail to act as a probe and to locate and enter the preformed nail hole through which it is to be driven, and a second position wherein the forwardmost nail of the strip remains in the hole and is positioned to be driven. Once the hole is located, the tool is pressed toward the workpiece causing the inner magazine portion to achieve its second position. The inner magazine portion is operatively connected to a safety trip which, when the inner magazine portion is shifted from its first position to its second position, shifts with it from a first trigger disabling position to a second trigger enabling position, so that the nail may be driven by the nailer. The inner magazine portion and the trip are biased to their first positions. This is basically a simpler and less complicated approach which requires no special probe, no special means to separate the forwardmost nail from the nail strip, and no special configurations on the first workpiece which has the preformed hole.

DISCLOSURE OF THE INVENTION

According to the invention there is provided a fastener driving tool of the type having a main body portion surmounting a guide body, a handle portion, and a magazine affixed to the guide body and the rearward end of the handle portion. The magazine contains a strip of nails. The main body portion of the tool contains a driver and a trigger actuated mechanism to drive and retract the driver. The guide body contains a drive track for the driver and is adapted to receive the forwardmost nail of the strip.

The fastener driving tool is not only capable of ordinary nail driving use, but is also designed to locate and align a preformed hole in a first workpiece with the drive track of the tool. Once the workpiece hole has been located and aligned with the drive track, the fastener driving tool is pressed toward the workpiece and the trigger is actuated to drive a nail through the preformed hole in the first workpiece and into a second workpiece, whereby the first workpiece becomes attached to the second workpiece.

The magazine of the fastener driving tool comprises an outer portion which is rigidly, but removably, affixed to an extension at the rearward end of the tool handle portion and to the guide body. An inner magazine portion is located within the outer magazine portion, extending the length thereof and being pivoted at its rearward end to the rearward end of the outer magazine portion. The inner magazine portion contains a strip of nails and the outer magazine portion mounts a spring-actuated feeder shoe which constantly urges the strip of nails in the inner magazine portion forwardly to locate the forwardmost nail in the drive track of the guide body.

The inner magazine portion is pivotable between a first position wherein the forwardmost nail of the strip extends well beyond the nose of the guide body, and a second position wherein the forwardmost nail of the strip is properly aligned within the guide body drive track to be driven by the tool driver. When the inner magazine portion is in its first position, the forwardmost nail serves as a probe, locating and entering the hole in the first workpiece. Thereafter, the fastener driving tool is pressed toward the first workpiece causing the inner magazine portion to shift to its second position. In this position, the forwardmost nail remains in the workpiece hole.

The fastener driving tool is provided with a safety trip which is shiftable between first and second positions. In the first disabling position of the safety trip, the trigger cannot be actuated. In its second enabling position, the safety trip enables the fastener driving tool trigger so that it can be actuated. Such safety trips are well known in the art. They are normally actuated by contact with the workpiece. In this instance, however, the workpiece is contacted by the forwardmost nail of the inner magazine portion. When the inner magazine portion is in its first position, the safety trip occupies its first disabling position. When the inner magazine portion is in its second position, the safety trip is shifted thereby to its trigger enabling second position. Both the inner magazine portion and the safety trip portion are biased to their first positions.

The inner magazine portion is provided with a pawl which controls the axial position of the forwardmost nail and which assures that the inner magazine moves to its second position when the nailer is pressed toward the workpiece. The pawl will be rocked out of the way by the tool driver during a fastener driving operation.

DETAILED DESCRIPTION OF THE INVENTION

Figure 1:
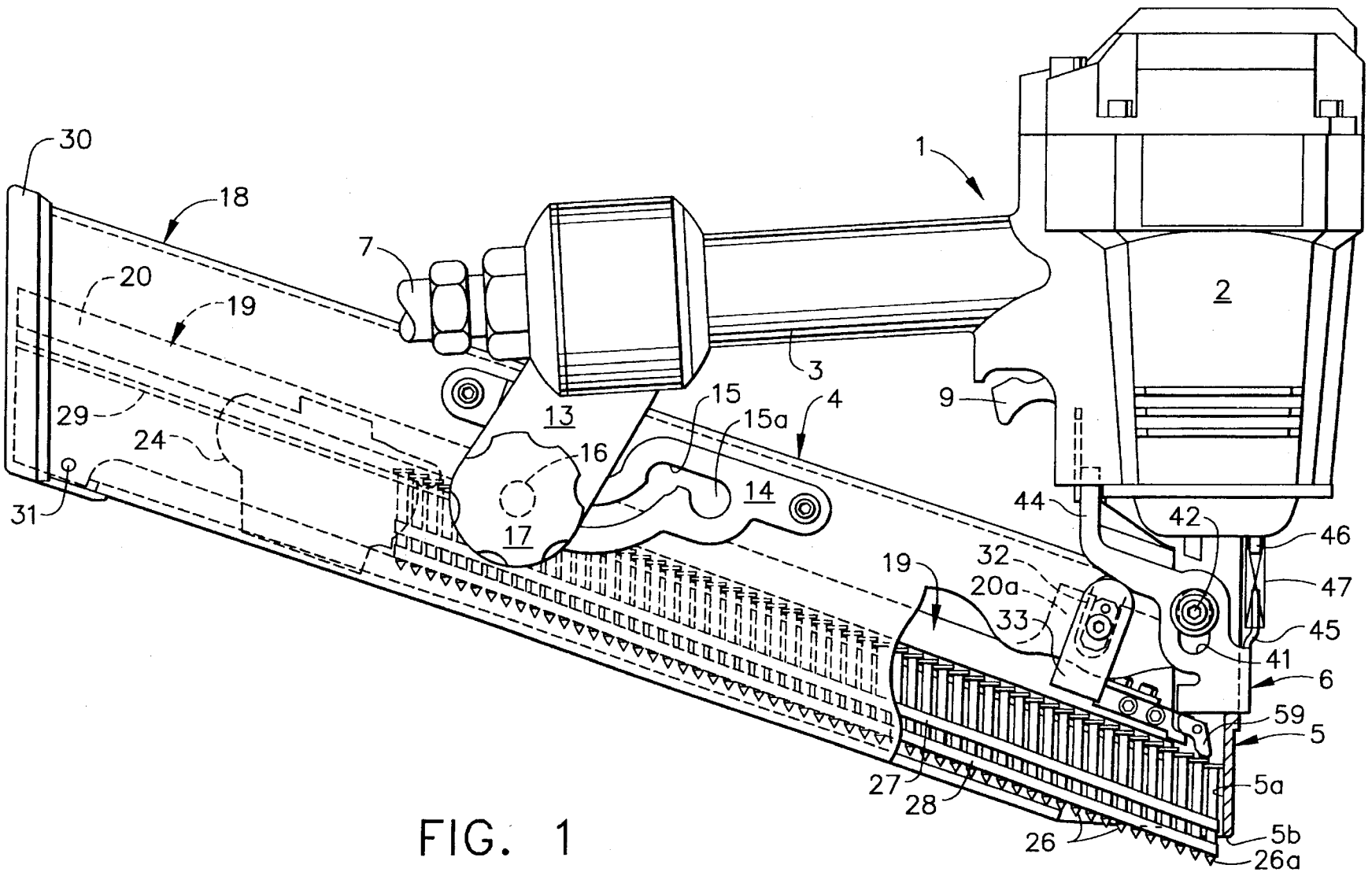
FIG. 1 is a right side elevational view of the tool of the present invention, partly in cross-section, showing the inner magazine portion in its first or extended position and the safety trip in its normal unactuated position.

Reference is now made to FIG. 1 wherein a nail driving tool is generally indicated at 1 having a main body portion 2 and a handle portion 3. The tool 1 is provided with the magazine 4 of the present invention, together with a modified guide body 5 and a modified safety trip 6 of the present invention. The tool 1 is illustrated as being a compressed air actuated tool, the rearward end of the handle portion 3 having a hose 7 removable attached thereto. The hose 7 leads to a source of compressed air (not shown).

Figure 7:
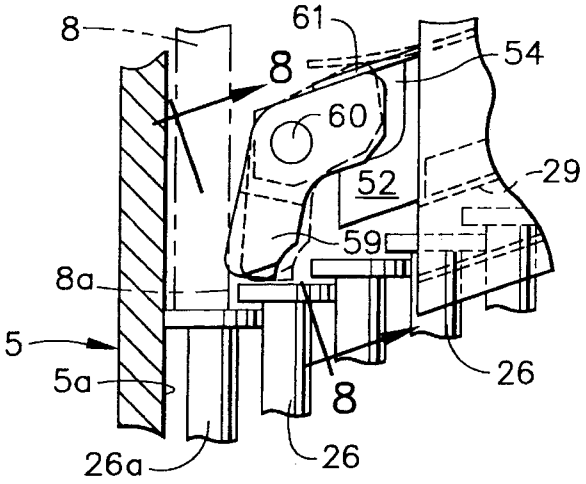
FIG. 7 is an enlarged fragmentary, cross-sectional view of the drive track and the pawl located therein.
Figure 6:
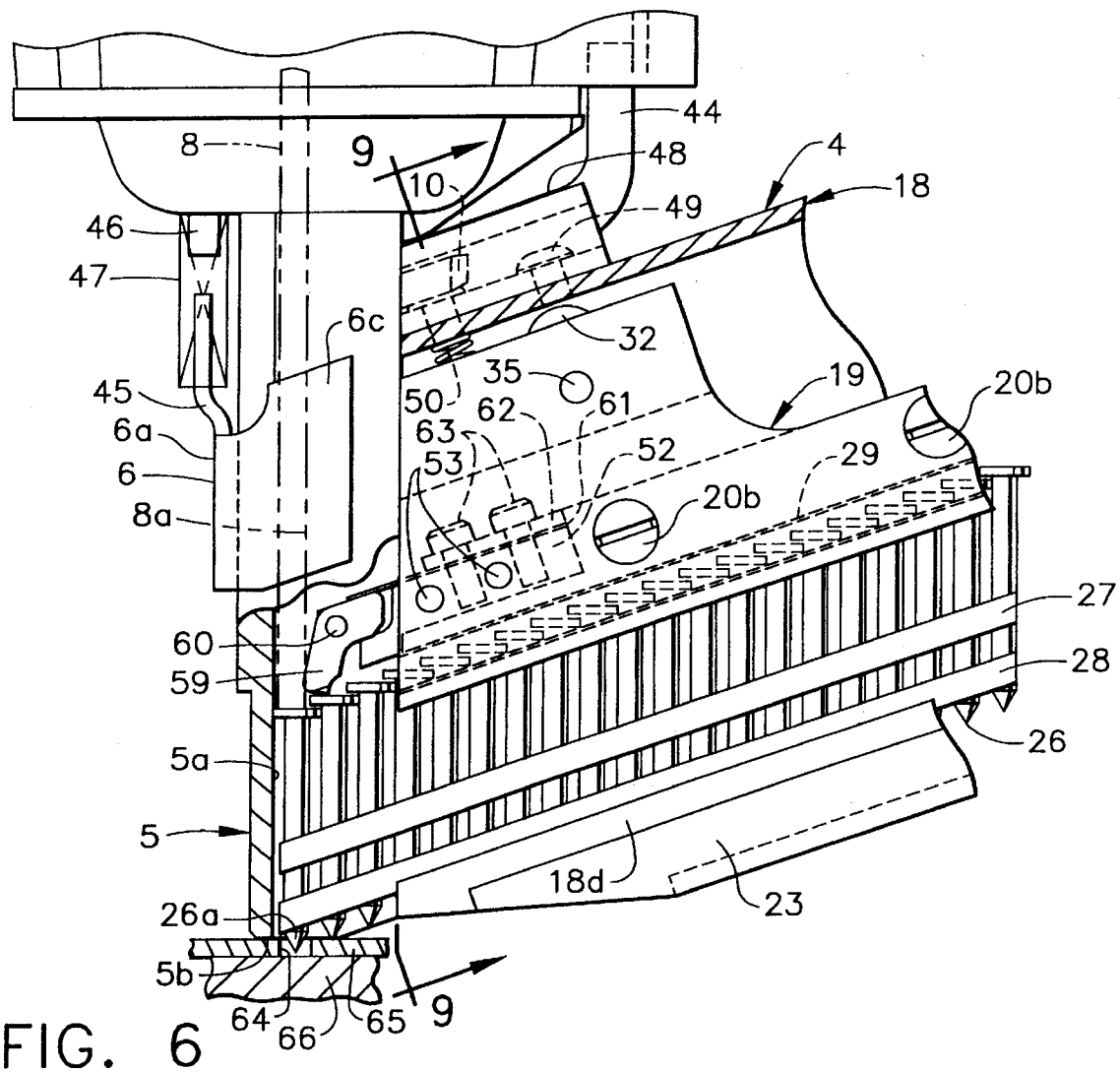
FIG. 6 is a right side, fragmentary, elevational view, partly in cross-section, illustrating the tool guide body and the forward portion of the magazine.

The main body portion 2 of the tool houses a main cylinder (not shown) containing a piston (not shown) and a driver (shown at 8 in FIGS. 6 and 7). The main cylinder is connected to air under pressure by means of a main valve (not shown) to force the piston and driver downwardly to drive nail into a workpiece. The main valve is actuated by a trigger valve (not shown). A trigger 9 operates the trigger valve. The mechanism just described within the main body portion is well known in the art. The precise nature of the tool 1 is not a limitation of the present invention. As indicated in the preamble portion of the present specification, fastener driving tools can also be actuated by other means including internal combustion means, electrical means, and the like. For purposes of an exemplary showing, the tool 1 illustrated in the drawings is a conventional nail driving tool manufactured by SENCO of Cincinnati, Ohio under the designation SN60.

Figure 9:
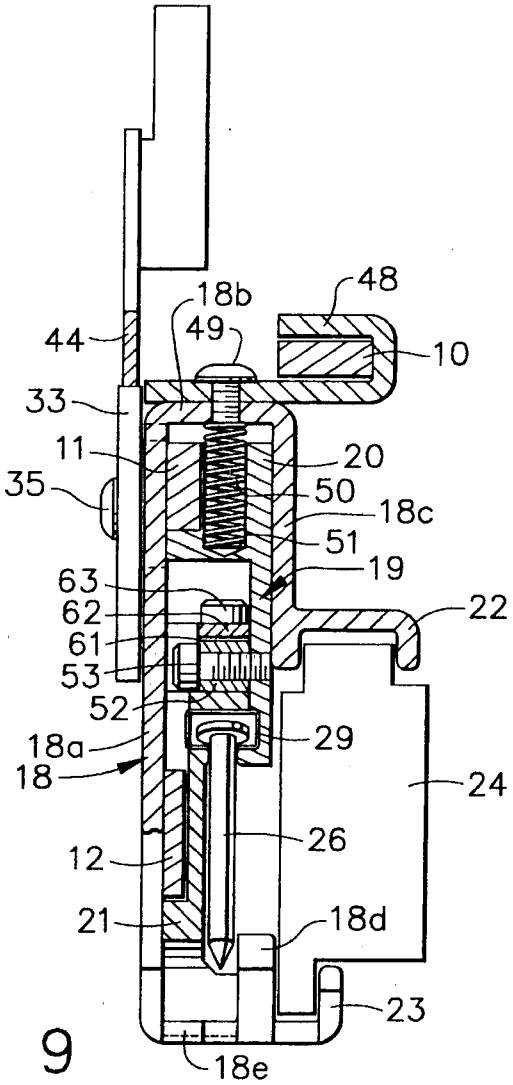
FIG. 9 is a cross-sectional view taken along section line 9—9 of FIG. 6.

The magazine 4 is attached at its forward end to guide body 5 by means of three lugs 10, 11 and 12 which are received within the forward end of magazine 4. The lugs 10, 11 and 12 are illustrated in FIG. 9 and will be further described hereinafter. The magazine 4 is further attached to a downwardly and rearwardly directed extension 13 which constitutes a part of handle portion 3. The magazine has affixed thereto a bracket 14 having an arcuate slot 15 formed therein. The head of a bolt 16 can be inserted through slot portion 15*a*. Elsewhere is slot 15 the bolt is captive with the head thereof located between the magazine 4 and the bracket 14. The bolt 16 is threadedly engaged in a threaded bore (not shown) through extension 13 and is provided at its free end with a knob 17. When the magazine 4 is appropriately mounted on tool 1, the knob 17 is turned so as to tighten the bolt 16 in the threaded bore in extension 13, bracket 14 being clamped between extension 13 and the head of bolt 16 to releasably lock magazine 4 in place.

As shown in FIG. 1, magazine 4 is made up of an outer magazine portion generally indicated at 18 and an inner magazine portion generally indicated at 19. Inner magazine portion 19, in turn, is made up of two parts, an elongated upper part 20 and an elongated lower part 21. It will be noted that the upper part 20 is of increased vertical dimension (as at 20*a*) adjacent its forward end. The reason for enlarged portion 20*a* will be apparent hereinafter. While shown in the drawings as being made up of two pieces 20 and 21, it is within the scope of the invention to make inner magazine portion 19 as an integral, one-piece structure. This is the preferred production approach, forming inner magazine portion 19 as a single extrusion or molding.

Still referring to FIG. 1, the outer magazine portion 18 of magazine 4 substantially completely surrounds inner magazine portion 19. Outer magazine portion 18 is provided with upper and lower integral, hook-shaped rails 22 and 23 on its left side (see FIGS. 4, 5 and 9). The hook-shaped rails 22 and 23 serve as guide rails for a conventional spring actuated feeder shoe 24. Feeder shoe 24 engages a strip of nails 25 slidably mounted within inner magazine portion 19 near the rearward end of the strip. Since the feeder shoe is constantly urged toward the guide body 5 of tool 1 by a spring (not shown), the strip of nails 25 will be constantly urged forwardly, assuring that the forwardmost nail of the strip will be located in the drive track 5*a* of guide body 5. The strip of nails 25 is conventional and well known in the art. The nails 26 are arranged in a tandem row with the head of each nail being overlapped by the head of the next nail therebehind. The nails are maintained in a strip by a pair of tape strips 27 and 28. Other means can be used to maintain the nails in a strip, as is well known in the art. Elongated plastic elements have been used heretofor, as have elongated wire elements individually welded to the shank of each nail.

As will be more fully set forth hereinafter, the inner magazine portion 19 has a C-channel running substantially the length thereof and accommodating the heads of the nails 26 of nail strip 25. This C-channel is clearly indicated at 29 in FIGS. 4–6, 8 and 9. It will be noted in these Figures that the C-shaped channel 29 is located between the upper portion 20 and the lower portion 21 of inner magazine portion 19.

The rearward end of outer magazine portion iris provided with an opening (not shown) whereby when a particular strip of nails is exhausted, a new one can be located in inner magazine portion 19. This having been done, the feeder shoe is pulled rearwardly in its tracks 22 and 23 to a position where it engages the rear portion of the new nail strip so that it can properly feed the new nail strip between each nailing operation. Finally, it will be noted that the rearward end of magazine inner portion 19 is pivoted by means of pivot pin 31 to the rearward end of magazine outer portion 18.

Figure 2:
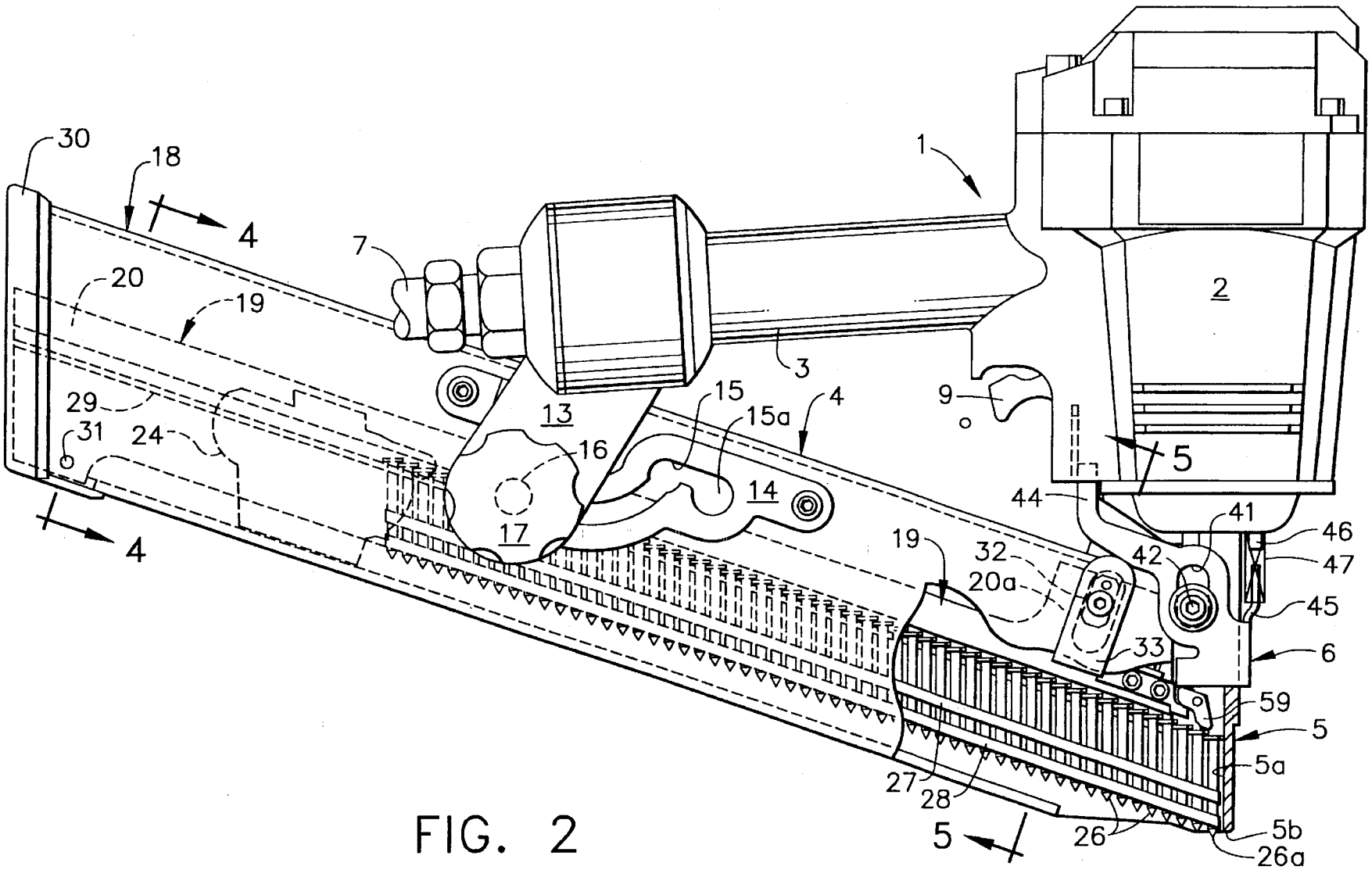
FIG. 2 is a side elevational view, partially in cross-section, similar to FIG. 1, but showing the inner magazine portion in its second or nail driving position and the safety trip in its trigger-enabling position.

FIG. 2 is a side elevational view, partly in cross-section, similar to FIG. 1. In FIG. 2, as is the case throughout the specification, like parts have been given like index numerals. FIGS. 1 and 2 differ from each other primarily in that FIG. 1 illustrates the inner magazine portion 19 in its first position and the forwardmost nail 26*a* is in its extended position wherein it can locate and enter a preformed hole in a workpiece. Since the inner magazine portion has rotated downwardly in a clockwise direction about pivot pin 31, as viewed in FIG. 1, the axis of the forwardmost nail 26*a* extends downwardly and very slightly rearwardly and is not strictly parallel to the axis of drive track 5*a*. In FIG. 2, the inner magazine portion 19 is shown in its second position wherein the nose 5*c* of guide body 5 is pressed against a workpiece (not shown). The inner magazine portion 19 has rotated about pivot pin 31 in a counterclockwise direction (as viewed in FIG. 2) from its first position shown in FIG. 1 to its second position shown in FIG. 2. In the second position of the inner magazine portion 19, the axis of the forwardmost nail 26*a* is substantially parallel to the axis of drive track 5*a*. It will be apparent from a comparison of FIGS. 1 and 2 that the amount of rotation of the inner magazine portion 19 about pivot pin 31 is quite small.

Figure 4:
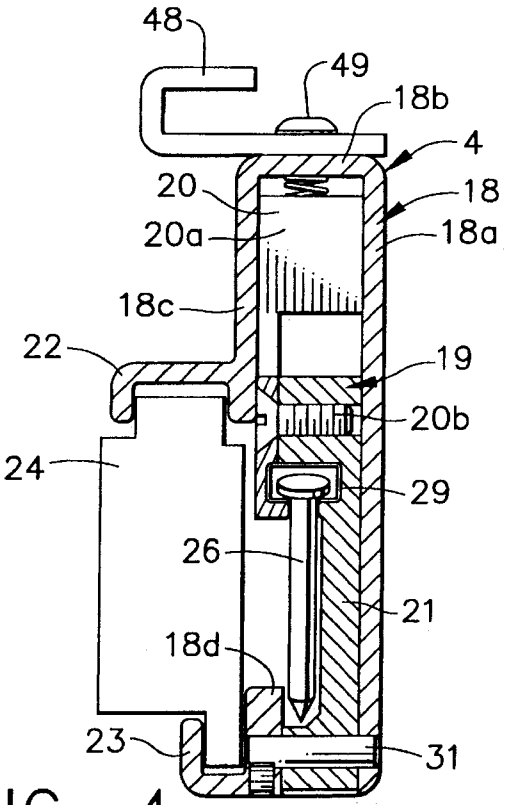
FIG. 4 is a cross-sectional view taken along section line 4—4 of FIG. 2.

Reference is now made to FIG. 4 which is a cross-sectional view taken along section line 4—4 of FIG. 2. It will be noted that FIG. 4 illustrates magazine 4 as viewed from a point near its rearward end and toward its forward end. For purposes of clarity, the tool 1 is not shown in FIG. 4. In FIG. 4 the outer magazine portion 18 is shown comprising a right vertical wall 18*a*, a top wall 18*b*, a upper left wall 18*c* and a lower left wall 18*d*. The hook-shaped rail 22 extends laterally from upper left wall 18*c* and the hook-shaped rail 23 extends laterally from lower left wall 18*d*. The conventional feeder shoe 24 is shown engaged by the rails 22 and 23.

As indicated above, the lower cartridge portion 19 is illustrated as being made up of an upper part 20 and a lower part 21 joined together by a series of machine screws 20*b*, one of which is shown in FIG. 4. The nail head carrying C-shaped channel 29 is also clearly shown in FIG. 4, located between the inner magazine portion parts 20 and 21. Again, this structure 20–21 would preferably be a one-piece, integral structure with channel 29 mounted therein.

Near its rearwardmost end, the outer magazine portion 18 does not have a bottom wall. This is to accommodate the slight rotation of inner magazine portion 19 about pivot pin 31. It will be noted that the lower end of inner magazine portion part 21 is L-shaped, extending beneath the adjacent one of the nails 26. Pivot pin 31 extends through the lowermost portions of the right wall 18*a* and the left wall 18*d* of outer magazine portion 18. Pivot pin 31 also extends through the L-shaped portion of the lowermost part of inner magazine member 19. In FIG. 4, the inner magazine member 19 is shown in its upper or second position, illustrated in FIG. 3.

Figure 5:
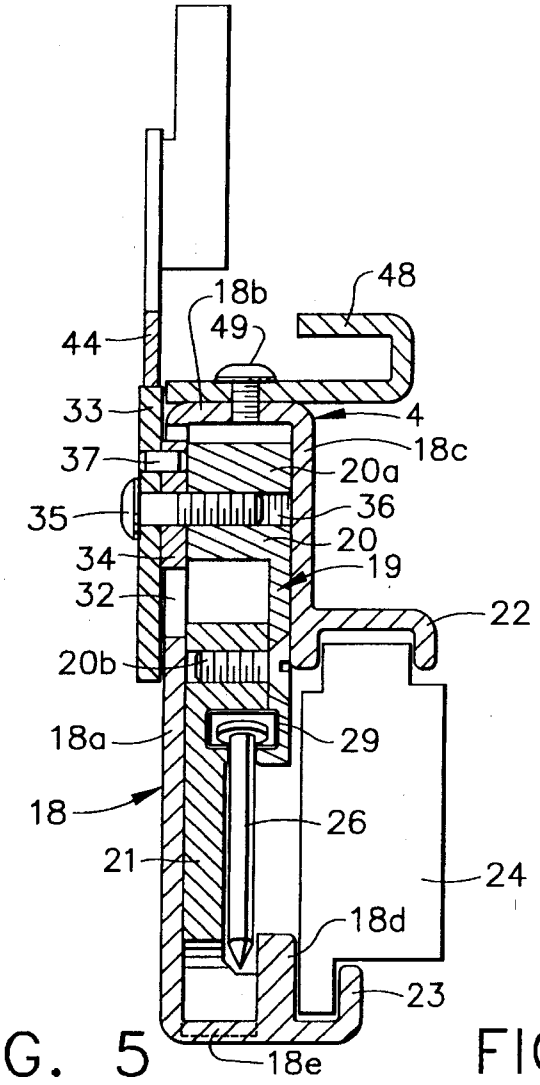
FIG. 5 is a cross-sectional view taken along section line 5—5 of FIG. 2.

Reference is now made to FIG. 5. FIG. 5 is a cross-sectional view taken along section line 5—5 of FIG. 2. Again, the tool 1 has been eliminated for purposes of clarity. It will be noted that in this instance, we are looking at a cross-section of magazine 4 in a direction toward the rearward end of the magazine. It will further be noted that at this position on the magazine, the outer magazine portion has a bottom wall 18*e*. The lower part 21 of the inner magazine portion 19 does not extend beneath the nail 26.

Figure 3:
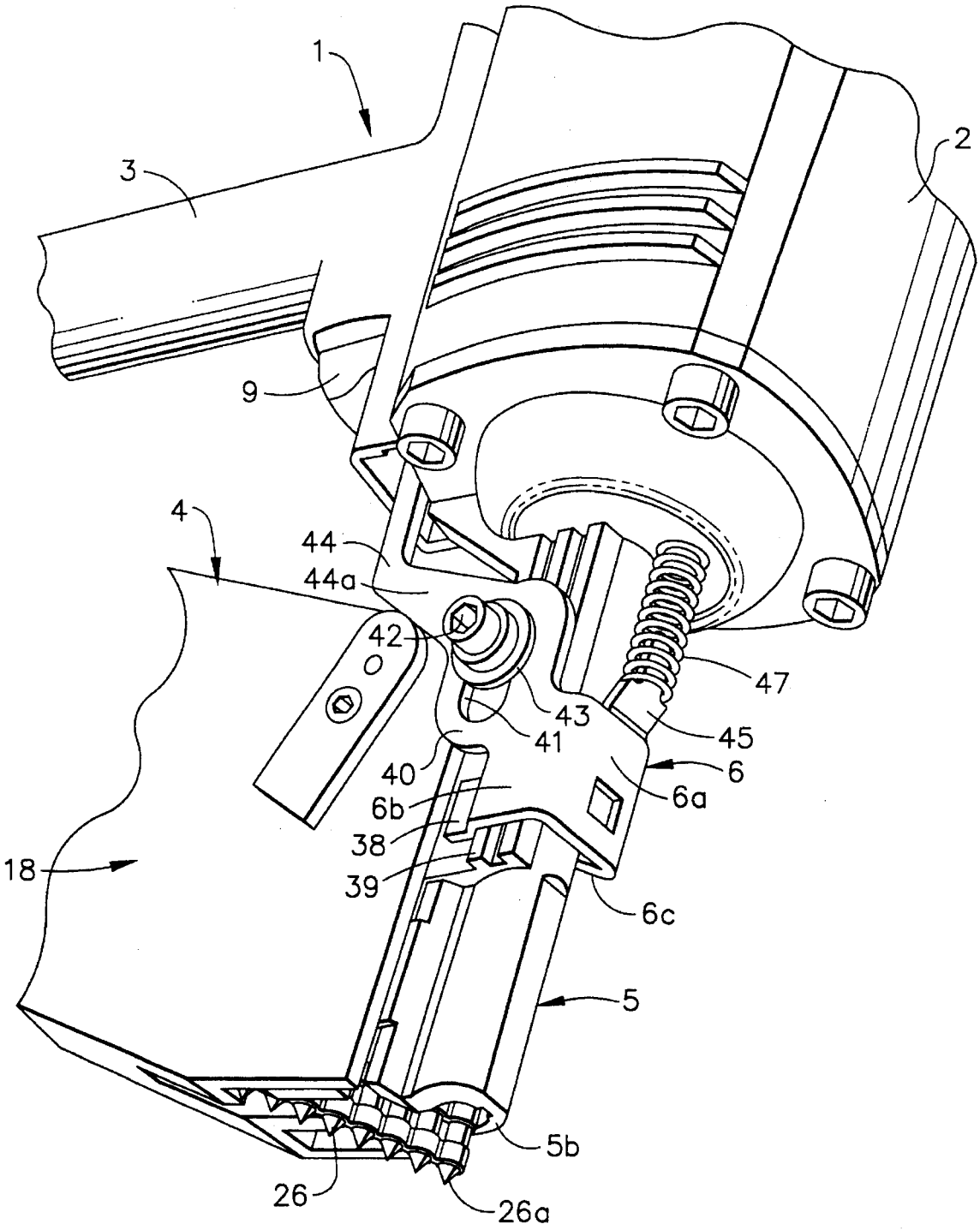
FIG. 3 is a fragmentary prospective view of the tool of FIGS. 1 and 2, showing the nose portion of the tool guide body and the first nail of the strip in its probe-like position.

At this position along magazine 4 the wall 18*a* of the outer magazine portion 18 is provided with a slot 32, the long axis of which is perpendicular to top wall 18*b* and bottom wall 18*e* of the outer magazine portion 18. The slot 32 has a spacer 34 mounted therein, and a plate-like safety trip actuator 33 is located exteriorly of slot 32 along the outside surface of wall 18*a*. The safety trip actuator, as is best seen in FIGS. 2 and 3, is of generally rectangular shape having a rounded upper end 33*a*. The safety trip actuator 33 and the spacer 34 are affixed to the enlarged upper portion 20*a* of inner magazine portion 19 by a machine screw 35 threadedly engaged in a threaded perforation 36 in the part 20*a* of inner magazine portion 19. Spacer 34 is so sized that it is slidable longitudinally within slot 32, the sides of slot 32 maintaining proper orientation of spacer 34. The safety trip actuator 33 is held in proper orientation by the combination of machine screw 35 and a pin 37 which joins the safety trip actuator 33 to spacer 34 and prevents any rotation of safety trip actuator 33 about screw 35. It will be evident from FIG. 5 that when the inner magazine portion 19 shifts between its first and second positions, safety trip actuator 33 and spacer 34 will shift with it.

Reference is now made to FIGS. 2, 3 and 6. In these Figures, safety trip 6 is illustrated. The safety trip 6 has a generally U-shaped body with a forwardly facing base portion 6*a* and rearwardly extending legs 6*b* and 6*c*. As is clearly shown in FIG. 6, leg 6*c* extends rearwardly along the left side of guide body 5.

Safety trip leg 6*b* extends rearwardly along the right side of guide body 5 and terminates in an inwardly and rearwardly extending tab 38 and rides along an elongated, vertical guide member 39 formed on guide body 5. The safety trip leg 6b also terminates in an enlarged upwardly extending portion 40 having an elongated slot 41 formed therein. A bolt 42, with a washer 43, extends through slot 41. The safety trip 6 is shiftable upwardly and downwardly along guide body 5. The tab 38 and the bolt 42 in slot 41 maintain the proper direction of the upward and downward movement of the safety trip.

Safety trip 6 has an L-shaped arm 44 having a first leg 44a comprising a one-piece, integral extension of the enlarged safety trip portion 40. The arm 44 has a second portion which extends upwardly to coact with trigger 9 to enable trigger 9 to actuate the trigger valve when the safety trip is in its second actuating or enabling position.

When the inner magazine portion 19 shifts from its first to its second position, the safety trip 6 will be shifted from its first to its second position by safety trip actuator 33, the rounded end 33a of which abuts safety trip arm 44. The safety trip 6 is shown in its first or unactuating position in FIG. 1 and in its second or actuating position in FIG. 2.

The safety trip 6 has, at the upper end of its base portion 6a an upstanding tine 45. The guide body has a downwardly depending pin 46 substantially aligned with tine 45. A compression spring 47 is anchored at its upper end on pin 46 and at its lower end on tine 45. Compression spring 47 returns the safety trip 6 to its first, unactuating position when the inner magazine portion returns to its first position. The uppermost position of the safety trip is determined by the uppermost position of safety trip actuator 33. The lowermost position of safety trip 6 is also determined by the lowermost position of safety trip actuator 33.

Reference is now made to FIGS. 6 and 9. In FIG. 9, the three rearwardly extending bosses of guide body 5 are illustrated at 10, 11 and 12. To accommodate boss 10, a hook-shaped bracket 48 is affixed to the upper wall 18b of outer magazine portion 18 by several machine screws 49. It will be noted from FIG. 6 that bracket 48 is relatively short, extending along upper wall 18b for a short distance. As is most clearly shown in FIG. 9, the guide body boss 11 extends into a notch made in the upper enlarged portion 20a of inner magazine portion 19. The guide body boss 12 extends between the lower portion 21 of inner magazine portion 19 and the side wall 18a of outer magazine portion 18.

Finally, it will be noted that the forwardmost machine screw 49 also serves as an anchor for the upper end of compression spring 50. Compression spring 50 is received in a blind bore 51 formed in the upper enlarged portion 20a of the inner magazine portion 19. The compression spring 50 serves to bias the inner magazine portion 19 to its lowermost or first position illustrated in FIG. 1. It will be noted that in FIGS. 4, 5, 6 and 9 the inner magazine portion 19 is shown in its upper or second position illustrated FIG. 3.

Figure 8:
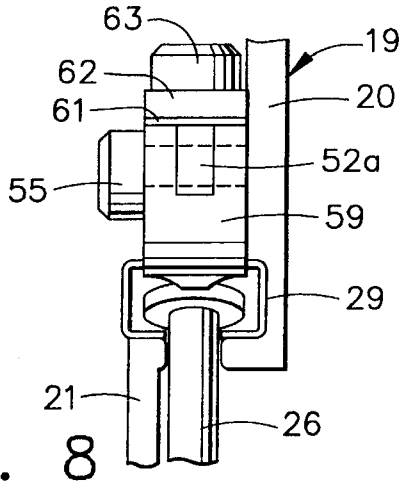
FIG. 8 is a front view of the pawl of FIG. 7 as seen along viewing lines 8—8 of FIG. 7.

Reference is now made to FIGS. 6, 7 and 8. An elongated block 52 is fastened to the upper portion 20a of inner magazine portion 19 by a pair of machine screws 53. At its forwardmost end, the block 52 has a notch formed in either side thereof. One of the notches is shown at 54 in FIG. 7. A central portion of block 52 is left between the notches, and is shown at 52a in FIG. 9. A pawl 59 is bifurcated and pivotally attached to block portion 52a by a pivot pin 60.

A spring metal plate 61 overlies the top of block 52 and the upper rearward end of pawl 59. Spring metal plate 61 is surmounted by a metallic retaining plate 62. The metallic retaining plate 62 and the spring metal plate 61 are affixed to block 52 by machine screws 63.

The spring plate 61 normally maintains the pawl 59 in position shown in FIGS. 1, 2, 6, 7 and 8. In this position, the nose of the pawl engages the head of the second nail 26 of the row. This assures that when the tool is pressed toward the workpiece, the nails engaging the workpiece will move upwardly in the guide body drive track 5a and, through the action of the pawl, the inner magazine portion 19 will move upwardly with the nails, to its second position. When the forwardmost nail of the row is also the last nail of the row, the pawl 59 will interact with the last nail in the same manner described with respect to FIGS. 7 and 9.

The driver 8 is a rod-like member provided with a longitudinal flat 8a. This results in a D-shaped cross section. The flat provides clearance between the driver 8 and the pawl 59. Should the driver (due to wear or the like resulting in slight mis-alignment of parts) contact pawl 59 during a driving stroke, the pawl will pivot out of the way about pivot pin 60, as is shown in broken lines in FIG. 7.

The tool, and the magazine and guide body of the present invention having been described in detail, the operation of the tool may be set forth as follows. A strip of nails is loaded in the inner magazine portion 19 of magazine 4, through the opening 30 at the rear of magazine 4. The feeder shoe 24 is positioned to urge the strip of nails toward the guide body 5. Under the influence of compression spring 50 (see FIG. 9) the inner magazine portion 19 will assume its first or downwardly extending position wherein the forwardmost nail 26a can serve as a probe. Similarly, the safety trip 6 will be urged downwardly into abutment with safety trip actuator 33 by the action of compression spring 47.

The operator positions the tool in such a manner that the forwardmost nail 26a of the row can locate and enter the preformed hole 64 in a first workpiece 65 (see FIG. 6). The intention, of course, is to drive the forwardmost nail 26a through the preformed hole 64 in the first workpiece 65 and into the second workpiece 66, thereby attaching the first workpiece 65 to the second workpiece 66. To this end, the operator, once the forwardmost nail 26a has located and entered the preformed hole 64, will press the tool 1 toward the first workpiece 65. The forwardmost nail of the strip will remain in the preformed hole 64 and will abut the second workpiece, shifting the inner magazine portion 19 to its upper or second position and at the same time the forwardmost nail will be properly located and aligned in the drive track 5a to be driven by the tool driver 8. Should the thickness of the first workpiece 65 be such that the forwardmost nail 26a of the strip cannot contact the second workpiece when the tool 1 is pressed toward the first workpiece 65, then the second nail of the strip will abut the first workpiece 65, causing the inner magazine portion 19 to shift to its upper or second position.

When the inner magazine portion 19 shifts to its second position, the safety trip actuator 33, attached to the inner magazine portion 19, will abut the arm 44 of safety trip 6, shifting the safety trip 6 to its second or enabling position against the action of compression spring 47. In this position, the safety trip 6 will enable trigger 9 and trigger 9 can be used to actuate the trigger valve which, in turn, opens the main valve allowing the compressed air to drive the piston and tool driver, to drive the nail 26a through the first workpiece 65 and into the second workpiece 66. When the tool is pressed toward the first workpiece 65, the pawl 59 will assure that the inner magazine portion 19 will be moved to its second position against the action of compression spring 50 by either the forwardmost nail 26a or the adjacent second nail of the strip.

As indicated above, when the forwardmost nail 26a is the last nail of the strip, it will contact pawl 59 and shift the inner magazine portion 19 to its second position when the nail contacts the second workpiece through the preformed hole 64. If the first workpiece is of a thickness such that the nail cannot contact the second workpiece, then the nail, being the last nail of the strip, cannot shift the inner magazine portion to its upper or second position. The safety trip 6 will remain in its unactuated position, and the tool will not drive the nail. When a second strip of nails is inserted in the inner portion 19, it will provide a second nail behind the single nail already in the drive track. This second nail will, when the tool 1 is pressed toward the first workpiece 65, contact the first workpiece 65 and will shift pawl 59 and the inner magazine portion 19 to its second position. The safety trip will shift to its enabling position and the fastener driving tool can be actuated.

Figure 10:
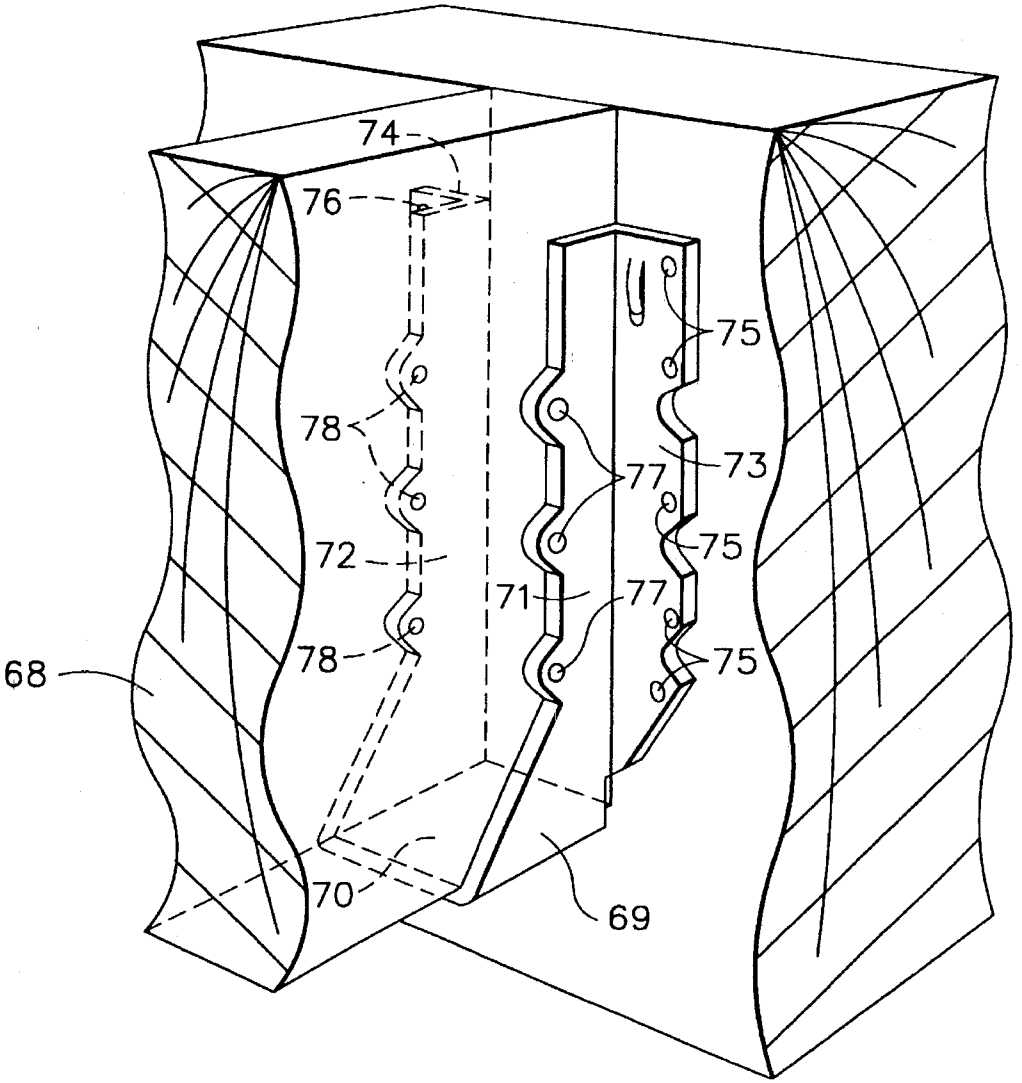
FIG. 10 is a fragmentary prospective view illustrating a typical joist hanger for attaching wooden beams together.

FIG. 10 illustrates a typical instance where the present invention can be advantageously employed. FIG. 10 fragmentarily illustrates a beam 67 and a joist 68. An exemplary joist hanger is shown at 69, partly in phantom. The joist hanger 69 has a substantially U-shaped body having a base 70 and upstanding legs 71 and 72 provided with laterally directed flanges 73 and 74. It will be noted that the U-shaped joist hanger 69 is dimensioned to just nicely receive the end of the joist 68.

Joist hanger 69 is first attached to the beam 67 by nails (not shown) passing through perforations 75 and 76 of flanges 73 and 74, and entering beam 67. Thereafter, the joist 68 is located in place, as shown in FIG. 10, and is attached to joist hanger 69 by nails passing through hanger holes 77 and 78. It will be appreciated that the nails used in this assembly will pass through pre-existing holes 75, 76, 77 and 78 formed in joist hanger 69. As indicated above, for each nail driven, it is important that its respective preformed hole in the joist hanger 69 be aligned with the drive track **5*a* of the fastener driving tool 1**.

As used herein and in the claims, such words as "uppermost", "lowermost", "vertical" and the like are used in conjunction with the drawing for purposes of clarity. It is apparent to one skilled in the art that the tool 1 may be held in any appropriate orientation, depending upon the work being done.

Modifications may be made in the invention without departing from the spirit of it.

What is claimed:

1. A fastener driving tool capable of locating a preformed hole in a first workpiece and of driving a fastener therethrough to join said first workpiece to a second workpiece, said fastener driving tool having a main body, a fastener driver in said body, a guide body attached to said main body, a drive track in said guide body for said driver, a magazine connected to said guide body and communicating with said drive track, a plurality of fasteners in said magazine in a tandem row including a forwardmost fastener and a fastener adjacent thereto, a feeder device to locate a forwardmost one of said fasteners into said drive track and a mechanism to actuate said driver through a drive stroke and a return stroke, said magazine having a fastener carrying portion, said magazine fastener carrying portion having a forward end adjacent said drive track, said magazine fastener carrying portion being shiftable between a first position wherein said forwardmost fastener is positioned to act as a probe to find and enter said preformed workpiece hole aligning said drive track and said hole, and a second position wherein said hole and said drive track remain aligned, said forwardmost fastener remains in said hole and said forwardmost fastener is properly positioned within said drive track to be driven by said driver through said preformed hole.

2. The fastener driving tool claimed in claim 1 wherein said magazine fastener carrying portion is biased to said first position thereof.

3. The fastener driving tool claimed in claim 1 wherein said magazine fastener carrying portion is shiftable to said second position thereof by abutment of one of said forwardmost and said adjacent fasteners against one of said first and second workpieces.

4. The fastener driving tool claimed in claim 1 including a safety trip shiftable on said guide body between a first unactuated position and a second actuated position wherein said safety trip enables said driver actuating mechanism to be actuable to drive a fastener from said drive track, said safety trip being biased to said first position thereof, said magazine fastener carrying portion shifting said safety trip to its second position when said magazine fastener carrying portion shifts to its second position.

5. The fastener driving tool claimed in claim 1 wherein said fasteners comprise nails.

6. The fastener driving tool claimed in claim 1 wherein said tool is a pneumatically actuated tool.

7. The fastener driving tool claimed in claim 1 wherein said magazine comprises an outer magazine portion having a forward end affixed to said guide body, a rearward end, and an inner magazine portion comprising said shiftable fastener carrying portion and located within said outer magazine portion, said inner magazine portion having a forward end adjacent said drive track and a rearward end pivotally attached to said rearward end of said outer magazine portion, said inner magazine portion being pivotable about said pivotal attachment between said first and second positions thereof.

8. The fastener driving tool claimed in claim 7 wherein said inner magazine portion is biased to said first position.

9. The fastener driving tool claimed in claim 8 wherein said inner magazine portion is shiftable to said second position thereof by abutment of one of said forwardmost and said adjacent fasteners against one of said first and second workpieces.

10. The fastener driving tool claimed in claim 9 including a safety trip shiftable on said guide body between a first unactuated position and a second actuated position wherein said safety trip enables said driver actuating mechanism to be actuable to drive a fastener from said drive track, said safety trip being biased to said first position, said inner magazine portion having a safety trip actuating assembly extending through said outer magazine member and in abutment with said safety trip, whereby when said inner magazine portion shifts from its first to its second position, said safety trip will be simultaneously shifted from its first position to its second position by said safety trip actuating assembly.

11. The fastener driving tool claimed in claim 10 wherein said fasteners comprise a strip of nails including a forwardmost nail and a nail adjacent thereto, said inner magazine forward end supporting a pawl, said pawl overlying at least said forwardmost nail of said strip, whereby said pawl insures that said inner magazine shifts to its second position when said tool is pressed toward said workpiece and said forwardmost nail shifts upwardly in said drive track.

12. The fastener driving tool claimed in claim 11 wherein said pawl is pivotally mounted to said inner magazine portion enabling said pawl to pivot out of the way of said driver.

13. The fastener driving tool claimed in claim 11 wherein said tool is a pneumatically actuated tool.

14. A magazine for a nail driving tool, said magazine comprising an outer magazine portion having forward and rearward ends and an inner magazine portion having forward and rearward ends and being located within said outer magazine portion, said inner magazine portion carrying a strip of nails arranged in a tandem row and including a forwardmost nail of said row, said rearward end of said inner magazine portion being pivotally attached to said rearward end of said outer magazine portion, said inner magazine portion being shiftable about said pivotal attachment between a first position wherein said forwardmost nail is in an extended probe-like position with respect to outer magazine portion and a second position wherein said forwardmost nail is positioned to be driven.

* * * * *